US005240117A

United States Patent [19]

Focke et al.

[11] Patent Number: 5,240,117

[45] Date of Patent: Aug. 31, 1993

[54] METHOD AND APPARATUS FOR ELECTRO-OPTICALLY SCANNING (CIGARETTE) PACKS

[75] Inventors: Heinz Focke, Verden; Uwe Dreyer, Wuppertal, both of Fed. Rep. of Germany

[73] Assignee: Focke & Co. (GmbH & Co.), Verden, Fed. Rep. of Germany

[21] Appl. No.: 868,091

[22] Filed: Apr. 14, 1992

[30] Foreign Application Priority Data

Apr. 15, 1991 [DE] Fed. Rep. of Germany ..... 4112263

[51] Int. Cl.[5] ..... B07C 5/00

[52] U.S. Cl. ..... 209/536; 198/626.1

[58] Field of Search ..... 209/536, 535; 198/626.1, 626.5, 626.6, 604

[56] References Cited

U.S. PATENT DOCUMENTS 2,689,647 9/1954 Hofstetter et al. ..... 209/90
3,939,984 2/1976 Butner et al. ..... 209/536

FOREIGN PATENT DOCUMENTS 258810 3/1988 European Pat. Off. .
0330495 2/1989 European Pat. Off. .
342384 11/1989 European Pat. Off. .
248960 8/1966 Fed. Rep. of Germany ... 198/626.1
2252451 3/1974 Fed. Rep. of Germany ... 198/626.1
2635519 2/1977 Fed. Rep. of Germany .
2844679 4/1979 Fed. Rep. of Germany .
2617457 5/1979 Fed. Rep. of Germany .
2932660 2/1981 Fed. Rep. of Germany .
3021806 11/1981 Fed. Rep. of Germany .
3443071 6/1985 Fed. Rep. of Germany .
3700928 7/1987 Fed. Rep. of Germany .
3605234 8/1987 Fed. Rep. of Germany .
3801388 7/1988 Fed. Rep. of Germany .
3942932 6/1991 Fed. Rep. of Germany .
2416060 8/1979 France .
2211810 7/1989 United Kingdom ..... 198/626.1

*Primary Examiner*—Robert P. Olszewski
*Assistant Examiner*—Kenneth Noland
*Attorney, Agent, or Firm*—Sughrue, Mion, Zinn, Macpeak & Seas

[57] ABSTRACT

Disclosed is a method and apparatus for electro-optically scanning (cigarette) packs. For an inspection of (cigarette) packs (10) as regards exterior appearance, electro-optical inspection means, particularly a camera (48) and a mirror (49) are used to produce images of the outer sides of the pack (10). In the region of an inspection station (20), the packs (10) are only engaged in the region of two diametrically opposite edges, particularly in the region of the short transverse edges (17, 18), in order to correctly and simultaneously detect all pack sides. As a result, the pack sides are exposed so that they can be scanned or photographed by appropriately positioned cameras or a camera and a mirror. The transverse edges (17, 18) bear on conveying strands (37, 38) of appropriately inclined conveyor belts (35, 36).

11 Claims, 2 Drawing Sheets

METHOD AND APPARATUS FOR ELECTRO-OPTICALLY SCANNING (CIGARETTE) PACKS

BACKGROUND OF THE INVENTION

The invention relates to a method for electro-optically scanning, especially for photographically imaging cubic or cuboid articles such as cigarette packs, with at least one inspection means (camera) arranged obliquely relative to the pack to be scanned. The invention further relates to an apparatus for electro-optically or photographically scanning cubic or cuboid articles.

Packs, especially cigarette packs of the hinge-lid type, are very thoroughly checked in the region of the packaging machine as regards correct structure. Recently, this check comprises a photographic inspection with the aid of fixedly installed cameras which detect the outer faces of the pack. The images produced therewith are compared to standard images. In the case of undesired variations of the external appearance, the defective packs are rejected.

Systems for electro-optically scanning (cigarette) packs are designed such that one or two cameras detect, i.e. produce an image of as many outer faces of the packs as possible while the packs are being transported. In a known apparatus (DE-A-38 01 388), the cuboid cigarette packs rest on their (large-surfaced) front panel while they are transported on a conveyor belt to which suction air is admitted. The free rear side and two adjoining faces can be detected by a camera arranged next to the transport path of the packs. A first conveyor belt is follwed by a second conveyor belt to which suction air is admitted as well and which engages the pack on the opposite side. A second camera can then detect the faces of the pack which are now exposed.

This known system has a relatively complicated structure. The conveyor belts to which suction air is admitted require an increased and permanent expenditure of energy.

SUMMARY OF THE INVENTION

The invention is based on the object to propose a method and apparatus for electro-optically scanning especially cuboid cigarette packs which allow an optimum all-around detection of the outer sides of the pack by simpler means.

To attain this object, the method according to the invention is characterized in that the pack is only held at two diametrically opposite corners or edges of the pack at least during the electro-optical scanning.

The invention is based on the idea to detect the packs during transport in the region of an inspection path in such a way that, on the one hand, they are conveyed correctly but that, on the other hand, all outer faces of the pack are exposed so they can be detected by the scanning means (cameras). This object is attained particularly advantageously if the packs are engaged by conveyor bands or belts in the region of the shortest diametrically opposite edges. These edges (transverse edges) are formed between, on the one hand, an end face or bottom face and, on the other hand, narrow elongate side faces.

In accordance with the inventive concept, the apparatus according to the invention is provided with endless conveying means, especially conveyor belts, which are located opposite in a diametric line of the cuboid packs and which engage the packs at two diametrically opposite parallel edges (transverse edges) during transport. In this process, the complete surfaces of two opposite sides of the pack are detected by inclined scanning means. Especially a camera and an oppositely situated reflector or mirror are installed for this purpose.

Further features of the invention relate to the structure of the apparatus, particularly the arrangement and design of conveying means for transporting the packs and to an ejecting means for defective packs.

An exemplary embodiment of the apparatus according to the invention will be described below in detail with reference to the drawings, in which:

DESCRIPTION OF A PREFERRED EMBODIMENT

Figure 1:
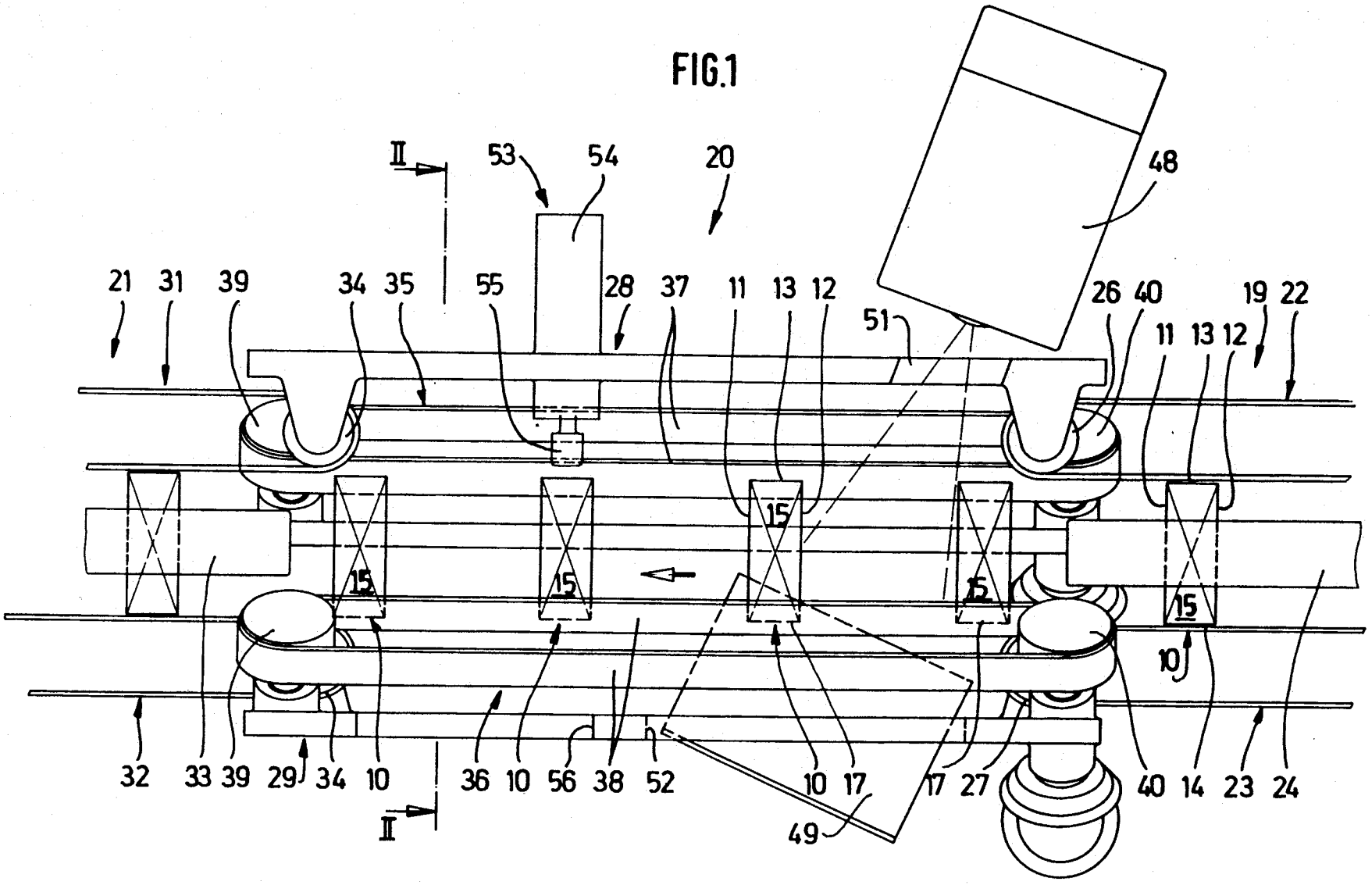
FIG. 1 is a side view of an apparatus for electro-optically scanning cuboid packs.

The exemplary embodiment of an inspection apparatus illustrated in the drawings serves for electro-optically or photographically scanning cuboid articles. It is particularly designed for inspecting (cigarette) packs 10 of the hinge-lid type.

The cuboid pack 10 is defined by outer faces of different sizes, particularly by a front face 11 and a rear face 12 which are connected to one another by relatively narrow elongate side faces 13, 14. The smallest faces are an end face 15 and, situated opposite thereto, a bottom face 16.

Said faces abut one another in the region of edges. The shortest edges are transverse edges 17, 18 which are formed between, on the one hand, the side faces 13, 14 and, on the other hand, the end face 15 or bottom face 16. Each of these transverse edges 17, 18 extends between front and rear corners of the pack 10.

The packs 10 are manufactured and filled in a packaging machine which is not shown in the drawings and are delivered to an inspection station 20 by a feed conveyor 19. After the electro-optical inspection of the packs 10, the intact or correct packs 10 are taken over by a discharge conveyor 21 which follows the inspection station 20. The packs 10 are transported continuously without any interruptions in the region of the feed conveyor 19, in the inspection station 20 and in the region of the discharge conveyor 21, without any variation of the given distances between the packs 10.

The feed conveyor 19 comprises an upper belt conveyor 22 and a lower belt conveyor 23. The packs 10 are transported in spaced relationship between the confronting conveying strands of these belt conveyors 22, 23, specifically in such a way that the entire surfaces of the narrow elongate side faces 13, 14 which are directed to the top and bottom are engaged by the relatively wide belt conveyors 22, 23. Accordingly, the belt conveyors 22, 23 have an additional function, specifically the stabilization of the cuboid pack shape by applying pressure on the side faces 13, 14 which are formed from adhesively bonded folding tabs.

Stationary lateral guides 24, 25 are arranged centrally between the belt conveyors 22, 23 to ensure a precise relative position of the packs 10 in the region of the feed conveyor 19. The packs 10 can contact these guides with the end face 15 and bottom face 16 for an adjustment of the relative position.

The belt conveyors 22, 23 are guided over deflecting rollers 26, 27 in the entry region of the inspection station 20. The deflecting rollers 26, 27 are mounted on supporting walls 28, 29 which are in their turn connected to a side wall 30 forming part of the machine frame.

The discharge conveyor 21 is designed analogously, particularly with belt conveyors 31, 32 and lateral guides 33. Deflecting rollers 34 of the best conveyors 31, 32 are also connected to the supporting walls 28, 29.

The packs 10 are to be transported in the region of the inspection station 20 in such a way that as many outer faces as possible or all outer faces are exposed. For this purpose, the packs 10 are engaged in the region of the inspection station 20 without any change of their relative position at two diametrically opposite short edges, particularly at the transverse edges 17 and 18, and are transported (further) in this manner.

For this purpose, endless conveyors are arranged in the region of an inspection path of the inspection station 20. These conveyors are in the form of conveyor belts 35, 36 which are inclined, that is to say they are guided to extend in oblique planes, such that the transverse edges 17, 18 rest approximately centrally against conveying stands 37, 38 of the conveyor belts 35, 36. Expediently, the conveyor belts 35, 36 are made of a soft elastic material, so that the transverse edges 17, 18 can be supported and guided without any danger of damaging the packs 10 through mechanical stress.

The conveyor belts 35, 36 are guided over deflecting rollers 39, 40 which are attached to obliquely mounted shafts 41, 42. In their turn, the shafts 41, 42 are mounted in inclined bearing sleeves 43. The lower outer bearing sleeve 43 is attached to the lower supporting wall 29. The upper bearing sleeve 43 is located on a supporting web 44 which is connected to the side wall 30.

One deflecting roller 40 of each conveyor belt is driven, in the present case specifically by a bevel wheel 45 which is engaged to a conical drive wheel 46 on a drive shaft 47. The drive shafts 47 are mounted in the side wall 30.

The conveyors 19, 21 and the conveyor belts 35, 36 are arranged such that the packs 10 are transported continuously, particularly at a constant conveying speed. Accordingly, the deflecting means are arranged such that the conveyor belts overlap.

Figure 2:
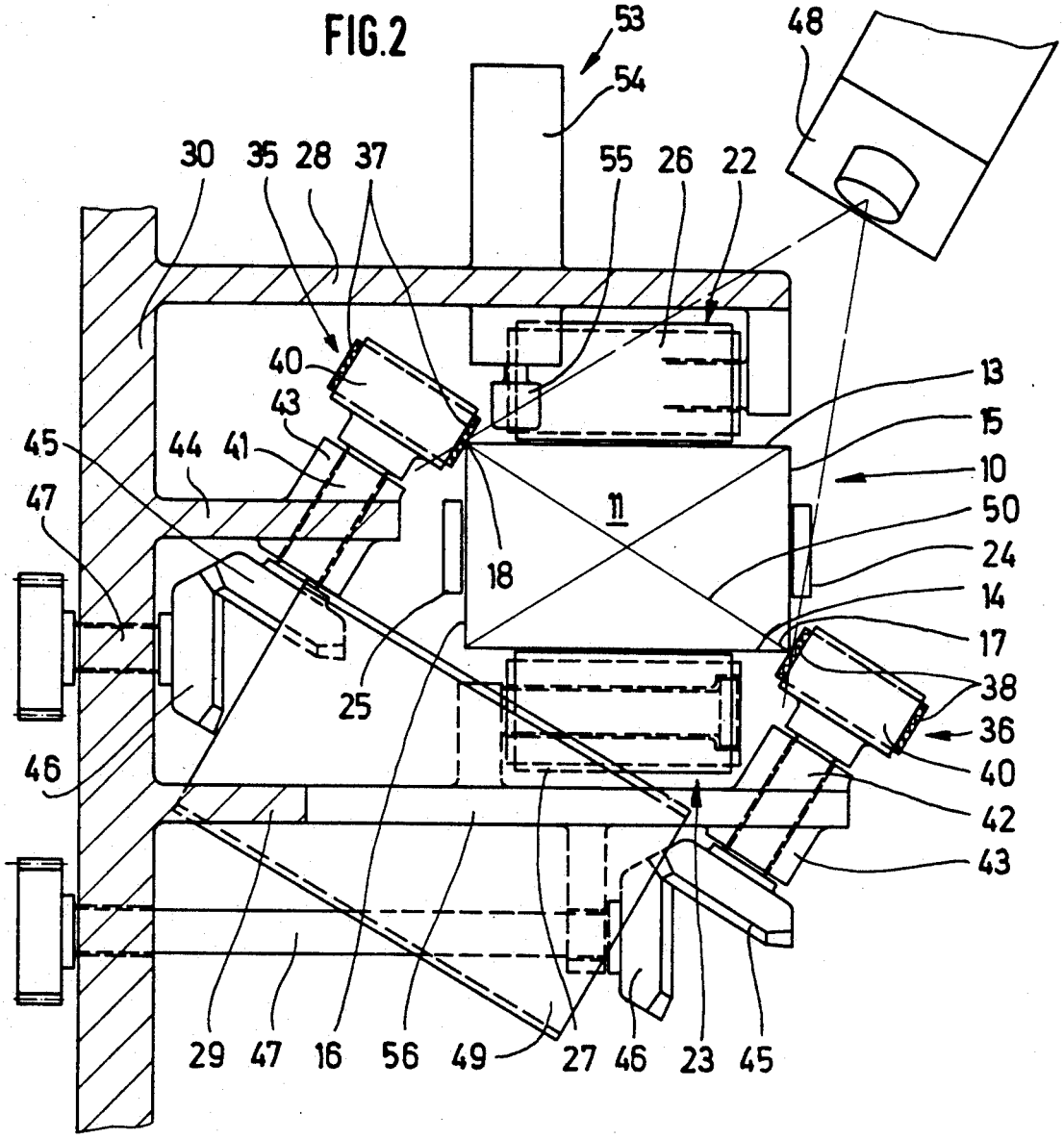
FIG. 2 is a section along line II—II of the apparatus of FIG. 1 on an enlarged scale.

A camera 48 and, with respect to the path of movement of the packs 10, oppositely thereto a mirror 49 acting as a reflector are arranged in the region of the inspection station 20 in order to photographically scan the outer faces of the packs 10. All sides of the pack 10 can be detected and scanned practically simultaneously by these two optical means. For this purpose, the camera 48 is arranged above the path of movement of the packs 10, specifically in an oblique position, such that the trailing face, i.e. the rear face 12 of the pack and the upwardly directed side face 13 and the outwardly directed end face 15 are detected. As it is evident from FIG. 2, the camera 48 is for this purpose arranged with its lens approximately centrally relative to an (imaginary) diagonal line 50 between the transverse edges 17, 18.

The mirror 49 is positioned correspondingly, such that it produces an image of the front face 11 which leads in the direction of movement of the packs 10 and the lower side face 14 and the inwardly directed bottom face 16. The image reflected by the mirror 49 is also recorded by the camera 48. The supporting walls 28, 29 are provided with passages 51, 52 for the optical beams and for the arrangement of the mirror 49.

Defective packs which are identified by a comparison of images are rejected in the region of the inspection station 20. For this purpose, an ejecting means 53 is fixedly disposed, particularly at the upper supporting wall 28. This ejecting means 53 comprises a pressure medium cylinder 54 whose piston 55 can contact an edge portion of the upper side face 13 in order to eject the pack 10. The (defective) pack 10 is thus downwardly pushed out from the position between the conveyor belts 35, 36 in a simple manner. The lower supporting wall 29 is provided with a recess 56 in the region of the ejecting means 53 for the defective pack to pass through.

We claim:

1. An apparatus for electro-optically scanning cuboid articles, such as cigarette packs of the hinge-lid type, with at least one inspection camera (48) which is located in an inspection station (20) and which is arranged obliquely relative to a pack (10) to be scanned, the packs being conveyed in a downstream direction through the inspection station, wherein:

a feed conveyor (19) is disposed upstream, and a discharge conveyor (21) is disposed downstream, of said inspection station (20);

in a region of the inspection station (20) the packs (10) are movable past the camera (48) by a conveyor consisting of two oppositely situated endless conveyor belts (35, 36); and the packs (10) are engageable and transportable by a conveying strand (37, 38) of each of the two oppositely situated endless conveyor belts (35, 36) only at diametrically opposite transverse edges (17, 18) of the packs.

2. The apparatus as claimed in claim 1, wherein:

the feed conveyor (19) consists of feed belt conveyors (22, 23) for engaging and transporting oppositely situated side faces (13, 14) of the packs; and an endless conveyor belts (35, 36) are arranged with an angle relative to the feed belt conveyors (22, 23), in order to transport the packs (10) in the region of the inspection station (20) such that the packs (10) are transportable without changing their relative position.

3. The apparatus as claimed in claim 2, wherein the cuboid packs (10) comprise a front face (11), a rear face (12), side faces (13, 14), an end face (15) and, opposite thereto, a bottom face (16), and wherein the packs (10) are engageable by the endless conveyor belts (35, 36) along the diametrically opposite pack (transverse edges 17, 18) which are formed between, on the one hand, a side face (13, 14) and, on the other hand, the end face (15) or bottom face (16).

4. The apparatus as claimed in claim 3, wherein the camera (48) is fixedly arranged next to the path of movement of the packs (10), such that a pack face trailing in the transport direction, an upper side face (13) and the end face (15) are detectable in the course of the electro-optical scanning.

5. The apparatus as claimed in claim 4, wherein a mirror (49) is fixedly arranged on the side of the path of movement of the packs (10) which is located opposite the camera (48) and wherein said mirror (49) produces an image of the faces of the pack (10) which are not detected by the camera (48).

6. The apparatus as claimed in claim 2, wherein the endless conveyor belts (35, 36) are guided over deflecting rollers (39, 40) with inclined axes of rotation, such that the transverse edges (17, 18) contact the conveying strands (37, 38) approximately centrally.

7. The apparatus as claimed in claim 2, wherein the camera (48) is arranged centrally relative to an imaginary diagonal line (50) between the transverse edges (17, 18) engaged by the endless conveyor belts (35, 36) and above the path of movement of the packs (10) and laterally offset thereto.

8. The apparatus as claimed in claim 2, comprising an ejecting means (53) for defective packs (10) which is arranged in the region of the inspection station (20) above the path of movement of the packs (10) adjacent to an upper transverse pack edge (18) and adjacent to an upper endless conveyor belt (35) for the upper transverse edge (18), such that a downward movement of a piston (55) downwardly ejects defective packs (10).

9. An apparatus for electro-optically scanning cuboid articles, such as cigarette packs of the hinge-lid type, with at least one inspection camera (48) arranged obliquely relative to a pack to be scanned, said packs (10) being movable past the camera (48) in a region of an inspection station (20) by means of endless conveyors, wherein:

the packs (10) are engageable and transportable by a conveying strand (37, 38) of each of two oppositely situated endless conveyor belts (35, 36) in the region of diametrically opposite transverse edges (17, 18) of the packs;

the cuboid packs (10) comprise a front face (11), a rear face (12), side faces (13, 14), an end face (15) and, opposite thereto, a bottom face (16);

the packs (10) are engageable by the endless conveyor belts (35, 36) along the diametrically opposite transverse edges (17, 18) which are formed between, on the one hand, a side face (13, 14) and, on the other hand, the end face (15) or bottom face (16);

the packs (10) are deliverably to the inspection station (20) by means of feed belt conveyors (22, 23);

the packs (10) contact said feed belt conveyors (22, 23), which are arranged above and below the path of movement of the packs (10), with oppositely situated pack surfaces (13, 14); and the endless conveyor belts (35, 36) are arranged in an oblique position relative to the feed belt conveyors (22, 23) in order to transport the packs (10) in the region of the inspection station (20) such that the packs (10) are engageable at the diametrically opposite transverse edges (17, 18) without changing their relative position.

10. An apparatus for electro-optically scanning cuboid articles, such as cigarette packs of the hinge-lid type, with at least one inspection camera (48) arranged obliquely relative to a pack to be scanned, said packs (10) being movable past the camera (48) in a region of an inspection station (20) by means of endless conveyors, wherein:

the packs (10) are engageable and transportable by a conveying strand (37, 38) of each of two oppositely situated endless conveyor belts (35, 36) in the region of diametrically opposite transverse edges (17, 18) of the packs; and the endless conveyor belts (35, 36) are guided over deflecting rollers (39, 40) with inclined axes of rotation, such that the transverse edges (17, 18) contact the conveying strands (37, 38) approximately centrally.

11. An apparatus for electro-optically scanning cuboid articles, such as cigarette packs of the hinge-lid type, with at least one inspection camera (48) arranged obliquely relative to a pack to be scanned, said packs (10) being movable past the camera (48) in a region of an inspection station (20) by means of endless conveyors, wherein:

the packs (10) are engageable and transportable by a conveying strand (37, 38) of each of two oppositely situated endless conveyor belts (35, 36) in the region of diametrically opposite transverse edges (17, 18) of the packs; and the camera (48) is arranged centrally, relative to an imaginary diagonal line (50) between the transverse edges (17, 18) engaged by the endless conveyor belts (35, 36), and above the path of movement of the packs (10) and laterally offset thereto.

* * * * *